US005161478A

United States Patent [19]

Strieb

[11] Patent Number: 5,161,478

[45] Date of Patent: Nov. 10, 1992

[54] TEMPORARY INSECT SCREEN FOR BOATS AND THE LIKE

[76] Inventor: Stephen F. Strieb, 9 Partridge Ct., Novato, Calif. 94947

[21] Appl. No.: 640,886

[22] Filed: Jan. 14, 1991

[51] Int. Cl.[5] ..... B63B 17/00

[52] U.S. Cl. ..... 114/361; 114/201 R; 160/377

[58] Field of Search ..... 114/178, 177, 211, 173, 114/201 R; 98/88.1; 296/97.8, 149, 148; 160/377

[56] References Cited

U.S. PATENT DOCUMENTS

| | | | |
|---|---|---|---|
| 4,434,740 | 3/1984 | Childs | 114/211 |
| 5,003,905 | 4/1991 | Raynor | 114/201 R |
| 5,022,339 | 6/1991 | Baskin | 114/211 |

*Primary Examiner*—Edwin L. Swinehart

*Attorney, Agent, or Firm*—Harold D. Messner

[57] ABSTRACT

In accordance with the invention, the device is provided for constructing a temporary screen for openings of a boat, comprising a central section of conventional screening material, an edging of a color-dyeable strong support material having an inner edge sewn about the perimeter of said central section of screening material and an outer edge, said edging being formed of a strong lightweight material, said outer edge of said edging having a sewn hem therealong into which a weighted chain is attached whereby said weighted chain resides in full pressure contact about an opening to be screened of said boat in an operating mode of said device, and said edging is positioned in abutting broad contact with framing means of said opening to better withstand any frictional abuse generated by frequency of contact therebetween. Method steps related to use and manufacture are also recited.

22 Claims, 3 Drawing Sheets

TEMPORARY INSECT SCREEN FOR BOATS AND THE LIKE

SCOPE OF THE INVENTION

This invention relates to an insect screen for boats for covering hatches, companionways, vents and the like and more particularly to a temporary screen for such purpose that is disconnectably attachable about the opening to be screened. In one aspect, the invention permits quick removal of the screen to permit easy entrance and egress through the hatch or companionway. In another aspect, stowage is enhanced because of the many constructional features of the screen. In yet another aspect, the sealing pressure of the screen relative to its associated horizontal, slanted, curved or irregular attaching surface about the hatch or companionway is surprising strong, viz., able to withstand the pressure of high winds, say 30 knots, without parting.

BACKGROUND OF THE INVENTION

Pleasure sailing as well as power boating has increased in frequency with each passing year. Overnight cruises are an important aspect of such increases. With respect to the latter, the boat is taken from one berth to another of relative close proximity, and during such stay the boat is used as eating and sleeping quarters at the latter location before the return home. Since the boat is usually not air conditioned, the hatches and companionway are often left open to admit cooling breezes during the night especially in locations near the Equator or during the summer months of more temperate climes. But insects are also attracted to the interior of the boat through such open hatches or companionways. Because most boats do not have permanent, manufacture supplied screens, these pests have heretofore being dealt with by constructing temporary screens using a screening kit comprising a screen and a Velcro-type attaching means (Velcro is a registered trademark). Usual construction techniques includes cutting the screen to fit the opening followed by attaching the hook and loop segments of the Velcro attaching means at the adjacent edges of the screen and sides of the hatch or companionway. But experience has shown that such screens are difficult to construct because of the irregularity of the sides of the boat openings; suffer from failure during construction and usage, i.e., rips, tears, dislodgement and the like; also either the hook or loop segments is permanently attached to the edges of the hatch or companionway to be screened and remain there when the screen is removed creating an unsightly entryway with glue line and tape that attracts lint and dirt and which is difficult to clean. If another construction common to the boating community is used, viz., to build a hard wooden framework to which the screen is attached, there is the additional disadvantage of bulky stowage owing to difficulty in disassembly of the framework. Sealing on and about the irregular surfaces adjoining the screened opening may be difficult.

SUMMARY OF THE INVENTION

In accordance with the invention, the device of the present invention includes a central section of conventional screen of rectangular cross section, an edging of a color-dyed strong support material having an inner edge sewn about the perimeter of the section of screen. Preferably the edging is formed of a strong lightweight man-made material such nylon that is positioned in abutting contact with raised anti-flooding molding of the hatch or companionway to be screened. In that way, the edging is thus able to better withstand any frictional abuse generated by frequency of contact with the aforementioned molding. An outer edge is added at the terminus of the edging having a sewn hem therealong into which a weighted flexible chain is threaded. The hem follows the full perimeter of the edging of the screen whereby the chain resides in full pressure contact with an associated base adjacent to the moldings of the hatch or companionway. Such adjacent surface is usually just below the upright molding of the hatch or companionway and is often curved, slanted or irregularly shaped due to different structure thereabout. Inasmuch as the chain is both flexible enough to accurately follow the contour of such support structure surrounding the opening as well as being formed of a high density metal such as lead to add strength, once sealing pressure is established, such seal is difficult to break. The flexible chain (providing the seal mentioned above) also has an extremely low profile. Hence sidewise or vertical force to dislodge the seal must be quite large. If such force is the result of distributed pressure such as that provide by wind, the wind required to dislodge the seal must be high, as high as 40 or so knots. But if such force is sufficient and a portion of the hem rides up the sides of the anti-flooding molding of the opening, note further that such action also cause the chain to lose contact with the base. Then the full distributed weight of enclosed chain acts at the raised molding to resist further upward movement.

Fitting the screens of the invention about the hatch or companionway of the boat is straight-forward and generally takes only seconds if such operations are occurring above deck. However, a person closing the screen of the invention below deck must first position himself interior of the hatch or companionway and extend his arms through the opening to prevent the screen from collapsing to the interior of the boat. Then as his arms (and screen) are lowered (relative to the opening), the screen is worked in an up-and-down or side-to-side motion until the hem (with the flexible chain) is below the raised molding of the on all appropriate sides of the latter.

Opening of the screen is much more straight forward and usually includes the steps of thrusting one's hand under the hem, grasping the latter and raising the portion of the screen clear of the raised molding. Then as neighboring portions of the hem clear the molding, the screen is folded back upon itself and then stowed. Owing to its weighted perimeter, such screen can be easily refolded to a small package and stowed.

In the manufacture of the screen of the invention, the sizes of hatches and companionways of several different boats are determined. Then a median value is established associated with the midpoint of the edging of nylon or the like. In that way, a series of different openings can be accommodated by a single manufactured screen. The manufacture is easily accomplished due to the fact that the edging material with the weighted chain inserted and hemmed can be made in long contiguous rolls and then such edging can be cut from such rolls as needed and attached to any size screen. That is, after cutting of the central screen segment and edging has occurred, these elements are sewn together about their full perimeters.

In circumstances where the hatch is fitted with a transverse extending support arm, the user can himself make modifications to the screen to permit the latter to form a complete closure about such hatch. That is, where the opening has a hinged support cover and telescoping support arm and clamp to keep the cover in an open position, the screen can be modified as follows. First, the screen is lain over the opening so the central screen segment is centered. Then at a transverse side of the hem and chain nearest the telescoping support arm, a cut is made through the hem and chain parallel to the opposite edges of the opening toward the support arm. Next loop and hook segments of an associated Velcro attaching means are sewn about the edges of the cut. Such segments form a disconnectable closure to complete the modification.

The method and apparatus of the invention can also be applied to vents and funnels of such boats. Such construction is in the form of a cylinder closed at one end and open at the other, with the screening material forming the side wall (the length being equal to the height of the vent or funnel). The top and base are constructed of lightweight material such as nylon, with the base being manufactured in the manner of the aforementioned weighted flexible chain and hem.

DESCRIPTION OF A PREFERRED EMBODIMENT OF THE INVENTION

Figure 1:
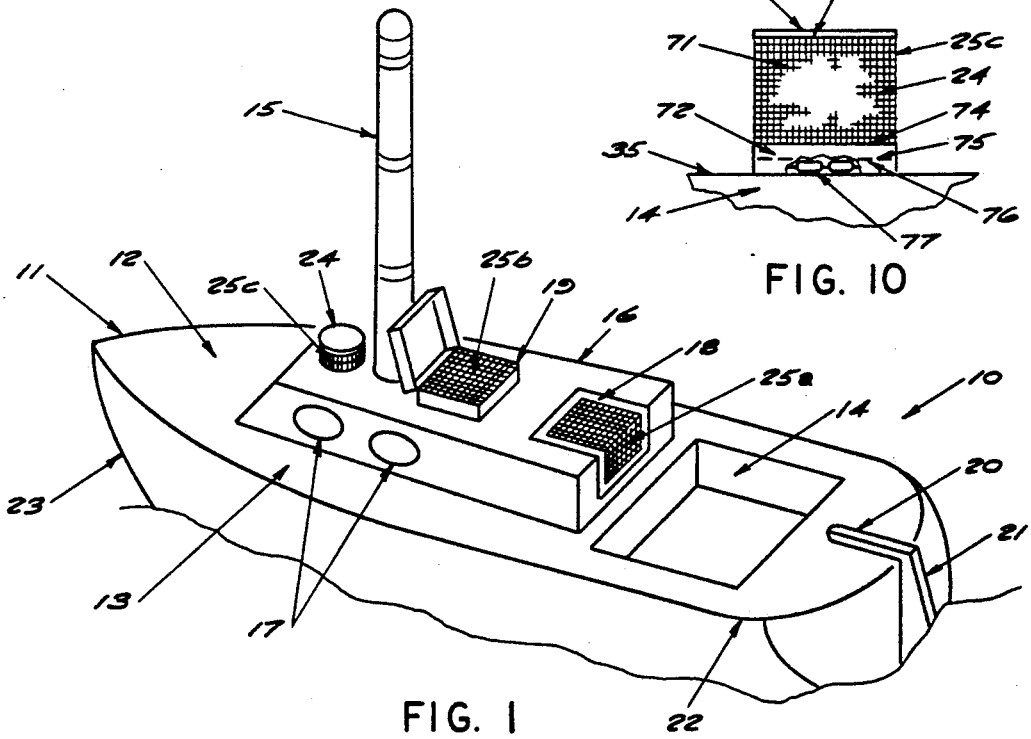
FIG. 1 is a perspective view of a sailing boat having a series of openings each fitted with the screen of the invention.

Referring to FIG. 1, there is shown a boat 10 comprising a hull 11, a foredeck 12, side decks 13 and cockpit 14. Between mast 15 and the cockpit 14 is cabin 16 having portholes 17. Connecting the cockpit 14 and cabin 16 is via companionway 18. The companionway 18 permits entry and egress to the cabin 16 from cockpit 14. Also connecting the interior of the cabin 16 to the exterior are hatch 19 and vent 24. Steering of the boat 10 at cockpit 14 is via tiller 20 connected to rudder 21 at the stern 22 of the boat 10.

As can be seen in FIG. 1, the mast 15 is shown denuded of sail, boom and rigging in order to better illustrate the invention. Likewise, at bow 23 of the boat 10, the jib sail also been omitted for a similar reason. Note also that the boat 10 is depicted as a sailing vessel and is for illustrative purposes only inasmuch as the invention applies equally to any type of vessel, motor or sail. Covering the companionway 18, hatch 19 and vent 24 are screens **25*a*, 25*b* and 25*c*, respectively, of the invention. These screens 25*a*, 25*b* and 25*c* are not only penetrable by cooling breezes but are disconnectably connected about the companionway 18, hatch 19 and vent 24** with sufficient force to withstand heavy winds and irregular shape of the pressure contact between such screens and such openings.

Figure 10:
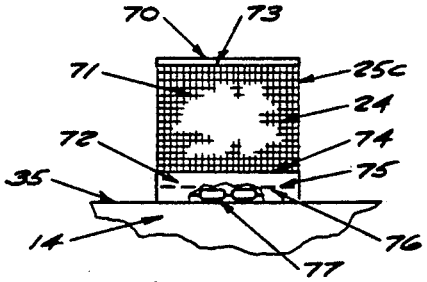
FIG. 10 is a side view of the screen of the invention attached about a vent of the sailing boat of FIG. 1.
Figure 2:
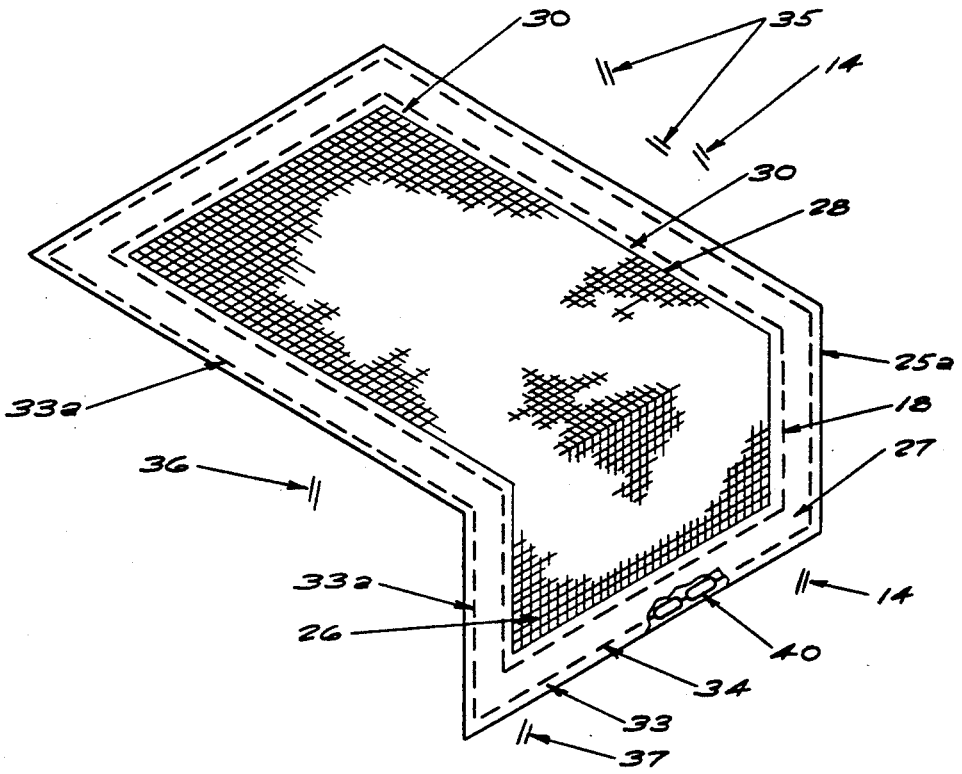
FIGS. 2 and 3 are perspective views of screens attached about a hatch, companionway and vents, respectively.
Figure 3:
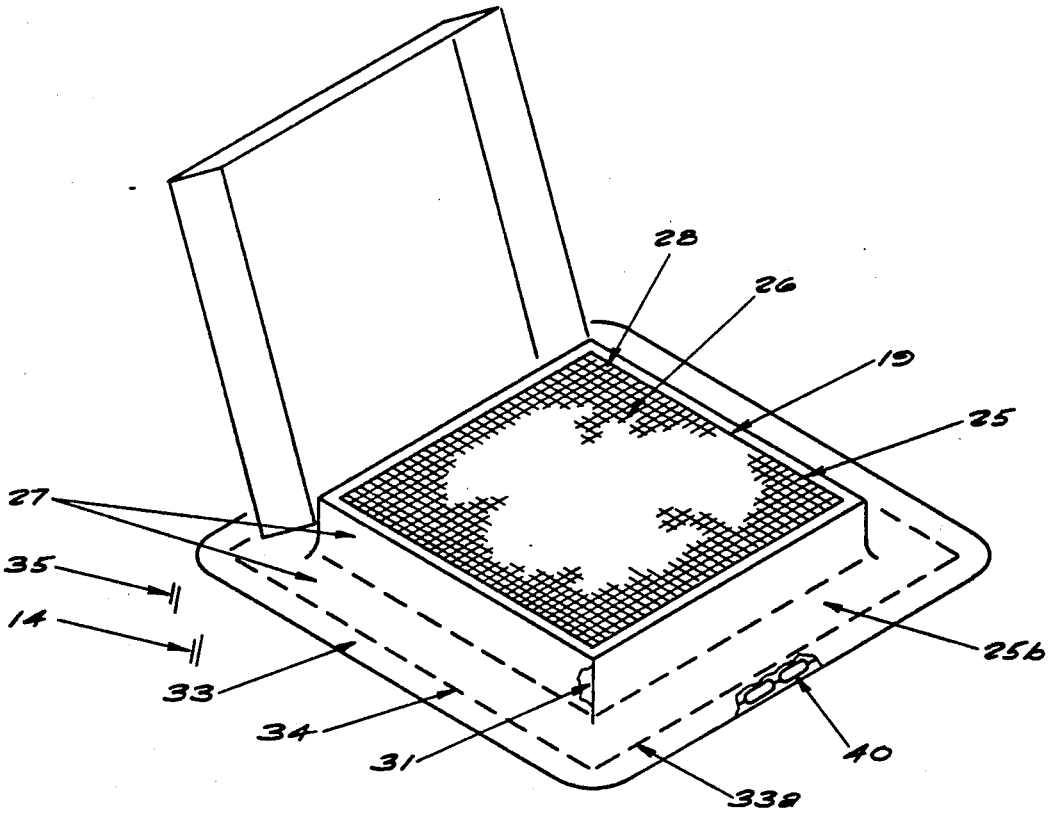

FIGS. 2, 3 and 10 show the screens **25*a*, 25*b*, 25*c* in position relative to the companionway 18, hatch 19 and vent 24**, respectively.

As shown in FIGS. 2 and 3, each screen **25*a*, 25*b* includes a rectangular central segment 26 of conventional screening material and a color-dyeable edging 27 forming a support rim for the segment 26. The edging 27 has an inner edge 28 sewn about the full rectangular perimeter of the segment 26. It is formed from a strong lightweight man-made material such as nylon. An outer edge segment 33 of the edging 27 is folded back on itself and then sewn along stitch line 33*a* to form a hem 34 into which a weighted flexible chain 40 is inserted. The hem 34 (and hence chain 40) are seen to follow the full perimeter of the support edging 27 whereby at least a portion of the edging 27, hem 34 and weighted chain 40 rests in sealing pressure about the companionway 18 or hatch 19 irrespective of the irregular shape of associated framework of such companionway 18 or hatch 19**.

Figure 11:
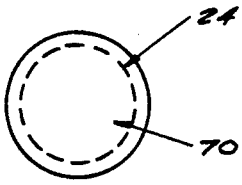
FIG. 11 is a plan view of the screen of FIG. 10.

As shown in FIGS. 10 and 11, screen **25*c* forms a cylindrical hat atop vent 24 and includes a circular central section 70 atop the vent 24 made of conventional color-dyeable material, a side screen segment 71 attached to the central section 70 and an end section 72. Attachments of these elements are at parallel circular seams established at 73 and 74**.

Note also that the end section 72 is also formed from a strong lightweight man-made material such as nylon akin to that used for central section 70 and includes a hem 75 formed by folding the end section 72 back on itself along seam 76 into which a weighted chain 77 is placed and attached. In positioning the central section 70 about the vent 24, contact is preferably limited to occur only between the stronger elements of the screen **25*c*, the roof 35 of the cabin 14 and the vent 24. That is, in FIG. 10, such contact occurs about central section 70 and the end section with respect to the vent 24 and roof 35 of the cabin 14**.

Likewise in similar fashion with respect to the screens **25*a*, 25*b* of FIGS. 2 and 3, positioning the edging 27 about the companionway 18 or hatch 19, contact is also preferably limited to occur only between the stronger elements of the screens 25*a* and 25*b* and the former. That is, in FIG. 2 such contact is limited to occur only between the edging 27 and L-shaped companionway molding 30, for example that frames the companionway 18. Likewise, in FIG. 3, contact between screen 25*b* and hatch 18 is along broad surfaces 29 of raised anti-flooding molding 31 that frame the hatch 18. One side of the molding 31 is seen to terminate adjacent to hinged cover 32**.

Thus the screens **25*a*, 25*b*, 25*c* of the invention are not only able to better withstand any frictional abuse, but also provide a surprising strong seal between the screens 25*a*, 25*b*, 25*c* about the companionway 18, hatch 19 and vent 24**, respectively.

In more detail, in FIG. 3, such sealing pressure about hatch 19 is at the intersection of the hem 34 and weighted chain 40 with roof surface 35 of cabin 14. While with respect to FIG. 2, sealing pressure about companionway 18 is at the intersection of the hem 34 and chain 40 and the following: the roof surface 35 of cabin 14 in the vicinity of the companionway 18, upright bulkhead surfaces 36 of the cabin 14 also in the vicinity of the companionway 18, and floor 37 of the cockpit 14. Further, in FIG. 10, such sealing pressure is established between the roof 35 and the weighted chain 77 (and associated hem 75) around the full circular perimeter of their intersection.

Figure 7:
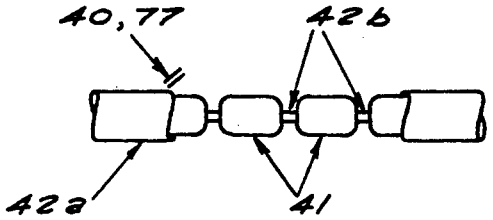
FIG. 7 is a detail of the weighted chain of FIGS. 5 and 6.

FIG. 7 illustrated the functioning of the weighted chain 40, 77 in more detail.

As shown, weighted chain 40, 77 includes a series of cylindrical links 41 of heavy metal such as lead within an outer sheath 42*a* of water-resistant plastic. The links 41 are attached together by a cable or line 42*b*, each link 41 including an opening (not shown) through out its length penetrated by cable 42*b* but is permanently attached to the latter so movement therebetween is not allowed.

Figure 4:
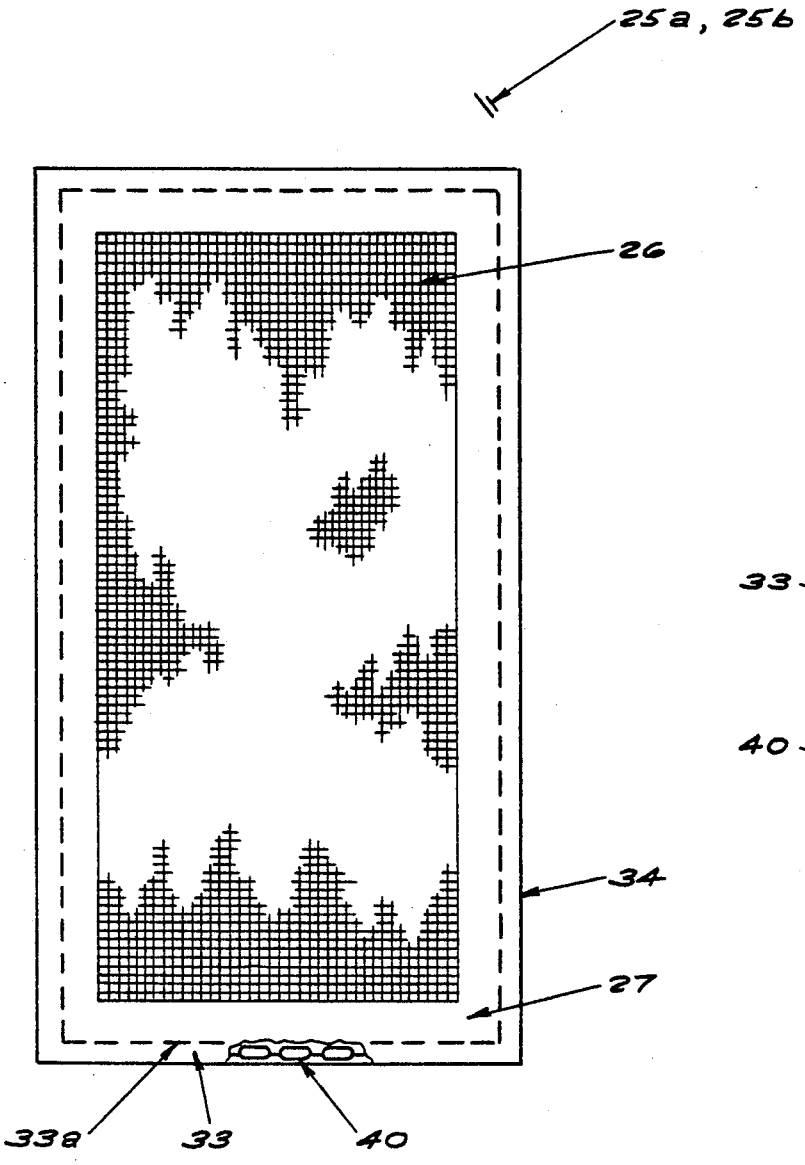
FIG. 4 is a plan view of the screen of the invention.
Figure 5:
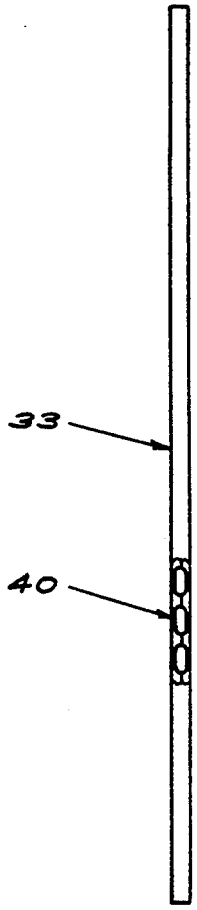
FIG. 5 is a side view, partially cutaway to show the weighted chain at edges thereof, of the screen of FIG. 4.
Figure 6:
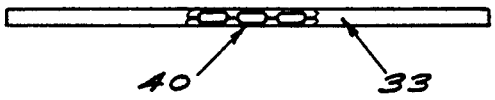
FIG. 6 is a front view of, partially cutaway to show the weighted chain at edges thereof, the screen of FIG. 4.

In operation, insertion of the weighted chains 40, 70 about the perimeter of the screens 25*a*, 25*b* and 25*c* is straight-forward. As shown in FIG. 4, for example, the chain 40 of screens 25*a*, 25*b* is inserted into and is attached to hem 34 after edge segment 33 of edging 27 has been folded back on itself and then sewn along stitch line 33*a* in the manner previously described. Note that the hem 34 (and hence the chain 40) follows the full rectangular perimeter of the latter, see FIGS. 5 and 6. In FIG. 10, the chain 70 of screen 25*c* is likewise inserted into and attached to hem 75 after the latter is formed and secured by seam 76 in the manner previously described. Note that the hem 75 (and hence the chain 77) follows the full circular perimeter of the latter.

Note also that full weight of the chains 40, 77 within each screen 25*a*, 25*b*, 25*c* of the invention, is supported in its preferred rest position by support structure adjacent to the companionway 18, hatch 19 and vent 24 over the full perimeter of the chains 40, 77 irrespective of the shape of such support structure. Inasmuch as the chain 40, 77 is formed of a high density metal such as lead, breaking the sealing pressure at its mating sealing surface as previously mentioned is difficult. That is, as previously stated the frictional force owing to the chain 40, 77 must be overcome by a sidewise- or vertically-directed exterior force. And if the force is the result of distributed pressure such as due to a high wind, owing to the low profile of the hem 34, 76 such force is much reduced. But even if such force is sufficient and a portion of the hem 34, 76 rides up off its sealing contact, note that such action ultimately causes the full distributed weight of the chain 40, 77 to act downward and resist further movement. In the case of the hatch 19 of FIG. 3, as the weighted chain 40 elevates along sides the anti-flooding molding 31, the distributed weight of chain 40 acts downwards. Such distributed weight further increases resistance to movement of the hem 34 and chain 40 since the former is always greater than the frictional force it generates.

Fitting the screens 25*a*, 25*b*, 25*c* of the invention about the companionway 18, hatch 19 and vent 24 is straight-forward and can be done in a few seconds if the person closing or opening the screen 25*a*, 25*b*, 25*c* is top-side, i.e., above deck.

If the person closing the larger screens 25*a*, 25*b* is below deck, however, he must position himself so that his arms extend through the horizontal plane of the companionway 18 or hatch 19. He supports, first, the screen 25*a*, 25*b* about his head. Then as he lowers his arms, the screen 25*a*, 25*b* is worked in an up-and-down or side-to-side motion relative to the foredeck 12 and bulkhead surfaces 36 until the hem 34 (with associated chain 40) is below the raised companionway molding 30 of FIG. 2 or below the molding 31 of the hatch 19 of FIG. 3 on all appropriate sides. Vent screen 25*c*, however, can be installed from an above-deck location only.

To open the screen 25*a*, 25*b*, 25*c* the process is reversed from that described above. These steps include thrusting one's hand under the hem, grasping the latter and raising the adjacent portion of the screen 25*a*, 25*b*, 25*c* clear of the raised companionway molding 30 of FIG. 2 or clear of the molding 31 and vent 24 of FIG. 3. As such raised portion of the hem 34 clear the latter, the user next folds the screen 25*a*, 25*b*, 25*c* back upon itself.

FURTHER METHOD ASPECTS

In the manufacture of the screens 25*a*, 25*b*, 25*c* of the invention, the sizes of companionways, hatches and vents of several different boats are determined. Then a median value is established. In that way, a series of different sizes and shapes of companionways, hatches and vents can be accommodated by a single manufactured screen 25*a*, 25*b* or 25*c*. Then in the case of screens 25*a*, 25*b*, 25*c*, their manufacture is easily accomplished due to the fact that the edging material with the weighted chain 40, 77 inserted and hemmed can be made in long contiguous rolls and then such edging can be cut from such rolls as needed and attached to any size screen. That is, after cutting of the central screen segment and edging has occurred, these elements are sewn together about their full perimeters.

Figure 8:
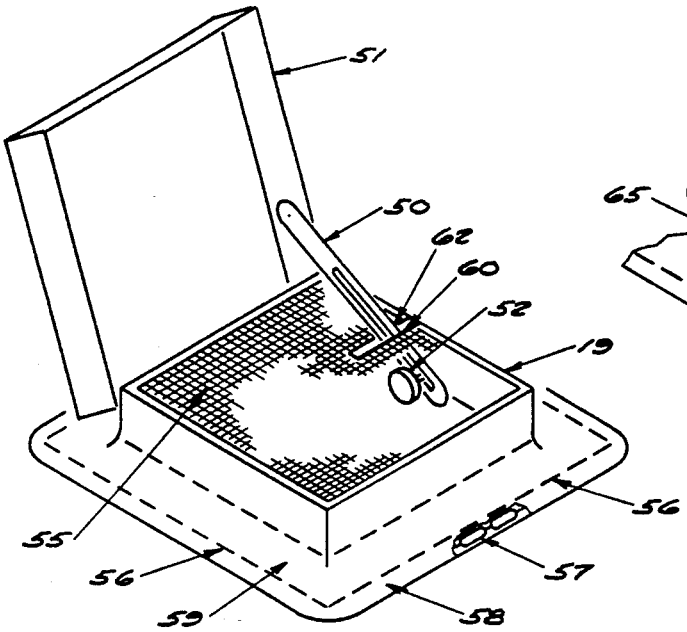
FIG. 8 is a perspective view, partially cutaway, of a screen modified to allow a arm of the hatch to extend therethrough.
Figure 9:
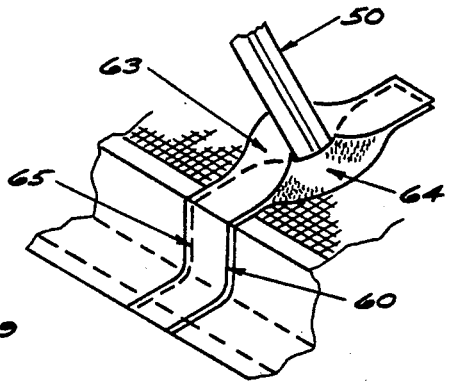
FIG. 9 is an enlarged detail of the cutaway segment of FIG. 8.

Note in FIGS. 8 and 9 that the hatch 19' has a telescoping support arm 50 for its cover 51. Such support arm 50 also has a manually adjustable clamp 52 to keep the cover 51 in an open position. In this circumstance, the screen 25*b'* can be modified as follows. First, the user lays the screen 25*b'* so that central screen segment 55 is centered over the hatch 19' and hem 56 (and chain 57) within edging 58 are correctly positioned, viz., centered relative to the hatch 19'. Then at a near side 59 of the modified screen 25*b'* (side 59 being nearest the telescoping support arm 50) is cut along line 60 through hem 56 and chain 57 of the edging 58 and thence through central screen segment 55 to the intersection 62 of the support arm 50 with the screen segment 55. Then loop and hook segments 63, 64 respectively, (see FIG. 9) of Velcro attaching means 65 are sewn about line 60.

The above description contains several specific embodiments of the invention. It is not intended that such be construed as limitations on the scope of the invention, but merely as examples of preferred embodiments. Persons skilled in the art can envision other obvious possible variations within the scope of the description. For example, the central screen segment can be formed of any flexible screening material through plastic is preferred. Hence the scope of the invention is to be determined by the appended claims and their legal equivalents.

What is claimed is:

1. In a device for providing a temporary screen for openings of a boat, the combination comprising an opening in a boat, said opening to be provided with a temporary screen and including framing means thereabout, a central section of screening material including an perimeter thereabout, an edging of a color-dyeable strong support material having an inner edge sewn about said perimeter of said central section of screening material and an outer edge, said edging being formed of a strong lightweight material, said outer edge of said edging a sewn hem therealong into which a weighted chain is inserted whereby said weighted chain resides in full pressure contact about said opening to be screened in an operating mode of said device irrespective of irregular shape of said pressure contact, and whereby said edging is positioned in abutting broad contact with said framing means of said opening to better withstand any frictional abuse generated by frequency of contact therebetween.

2. The combination of claim 1 in which said opening of said boat is a hatch of rectangular cross section having a hinged cover, said central section of screening material being of rectangular cross section and is adapted to fit about said hatchway in said operating mode of said device.

3. The combination of claim 2 in which said full pressure contact of said weighted chain and associated hem is substantially horizontal about said hatch.

4. The combination of claim 1 in which said weighted chain comprises a series of cylindrical links each having an opening therealong, an outer sheath and a central cable attached to said cylindrical links, said links being formed of a high density metal.

5. The combination of claim 1 in which said opening of said boat is a companionway, said central section of screening material is adapted to fit about said companionway in said operating mode of said device, and said framing means includes a L-shaped companionway molding thereabout.

6. The combination of claim 5 in which said full pressure contact of said weighted chain and associated hem is along a substantially horizontal but shape varying cabin roof, thence along a substantially vertical cabin bulkhead.

7. The combination of claim 1 in which said opening of said boat is a vent and said framing means is one of a cabin roof and boat deck through which said vent extends.

8. The combination of claim 7 with the addition of a central support section of light-weight material matched to that of said edging, said central support section being attached at the center of said central section of screening material so as to place said central support section atop of said vent.

9. The method of use of a device to provide a temporary screen for an opening of a boat, said device including a central section of screening material and an edging of a color-dyeable strong support material having an inner edge sewn about the section of screening material and an outer edge, said edging being formed of a strong lightweight material, said outer edge of said edging having a sewn hem therealong into which a weighted chain is inserted, comprising the steps of:

(a) positioning the central section of screening material about the opening to be screened, (b) manipulating said screen whereby the hem and associated weighted chain reside in full pressure contact about said opening to be screened irrespective of the shape of the pressure contact and whereby the edging is positioned in abutting broad contact with framing means of said opening to better withstand any frictional abuse generated by frequency of contact therebetween.

10. The method of claim 9 in which the full pressure contact of step (b) is difficult to break owing to the low silhouette of the hem and associated weighted chain.

11. The method of claim 10 in which force to dislodge the full pressure contact of the hem and chain must be large.

12. The method of claim 11 in which said force is wind in a range of at least 30 knots or higher.

13. The method of claim 9 in which step (b) is further characterized by a person being positioned below deck to effect closure by extending his arms to support the device above deck and then lowering the device into contact with the framing means of the opening to be screened using an up-and-down and side-to-side motion and terminating movement when the hem with the weighted chain therein, is beyond the framing means on all appropriate sides of the opening in sealing contact thereabout irrespective of the shape thereof.

14. The method of claim 9 in which step (b) is further characterized by a person being positioned below deck to effect opening by thrusting his hand under the hem and associated weighted chain, grasping the latter and raising same until the device is clear of the framing means of the opening, then folding the device back upon itself as neighboring portions of the hem clear the framing means.

15. The method of claim 14 with the additional step of refolding the device to a low profile due to its weighted perimeter and flexibility, and stacking the device in a storage area.

16. The method of claim 15 with the additional step of stacking a series of devices together in said storage area.

17. A method of manufacture of a device to provide a temporary screen for an opening of a boat, said device including a central section of screening material and edging of a color-dyeable strong support material having an inner edge sewn about the screening material and an outer edge, said edging being formed of a strong lightweight material, said outer edge of said edging having a swen hem therealong into which a weighted chain is inserted and attached, comprising the steps of:

(i) determining the sizes of different openings of several different boats, (ii) establishing a mean size therefor in which said edging of said device is always in contact with framing means of the different openings wherein the different openings can be accommodated by a single manufactured device, (iii) after cutting of the central screening material and the edging and sewn weighted chain therein to fit said mean size, sewing the screening and edging with chain therein together about their full perimeters.

18. The method of claim 17 in which said edging and weighted chain are formed by the steps of:

(a) hemming an outer edge of the edging, (b) fitting and attaching a weighted chain within the resulting hem, (c) forming the result into a roll for latter use.

19. The method of claim 17 wherein said opening is fitted with a hinged, rectangular support cover and telescoping support arm of a hatch, said telescoping support arm having a clamp therealong to keep the cover in an open position, the additional steps of laying the device of step (iii) over the opening so the central screening segment is centered thereon, then at a transverse side of the hem and chain nearest the telescoping support arm, cutting through the hem and chain parallel to the opposite edges of the opening toward the support arm, next attaching loop and hook segments of an associated Velcro attaching means about the edges of the cut wherein such loop and hook segments form a disconnectable closure about said telescoping arm.

20. A device for providing a temporary screen for openings of a boat, comprising a central section of screening material including a perimeter thereabout, an edging of a color-dyeable strong support material having an inner edge sewn about said perimeter of said central section of screening material and an outer edge, said edging being formed of a strong lightweight material, said outer edge of said edging having a sewn hem therealong into which a weighted chain is inserted whereby said weighted chain resides in full pressure contact about an opening to be screened in an operating mode of said device irrespective of irregular shape of said pressure contact, and whereby said edging is positioned in abutting broad contact with framing means of said opening to better withstand any frictional abuse generated by frequency of contact therebetween.

21. The device of claim 20 in which said weighted chain comprises a series of cylindrical links each having an opening therealong, an outer sheath and a central cable attached to said cylindrical links, said links being formed of a high density metal.

22. The device of claim 21 in which said high density metal forming said links is lead.

* * * * *